US006220886B1

(12) United States Patent
Kurimoto

(10) Patent No.: US 6,220,886 B1
(45) Date of Patent: Apr. 24, 2001

(54) CONNECTOR

(75) Inventor: Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/431,068

(22) Filed: Nov. 1, 1999

(30) Foreign Application Priority Data

Nov. 2, 1998 (JP) ..... 10-312349

(51) Int. Cl.[7] ..... H01R 13/627
(52) U.S. Cl. ..... 439/352; 439/347
(58) Field of Search ..... 439/352, 752, 439/595, 469, 15, 347

(56) References Cited

U.S. PATENT DOCUMENTS

| | | | | |
|---|---|---|---|---|
| 4,772,229 | * | 9/1988 | Nix et al. | 439/733 |
| 5,167,534 | * | 12/1992 | Ohsumi | 439/595 |
| 5,370,552 | * | 12/1994 | Chishima et al. | 439/495 |
| 5,876,230 | * | 3/1999 | Nishide et al. | 439/352 |
| 5,934,946 | * | 8/1999 | Nakamura | 439/752 |
| 6,022,238 | * | 2/2000 | Tomita et al. | 439/352 |
| 6,045,375 | * | 4/2000 | Aoki et al. | 439/157 |
| 6,068,522 | * | 5/2000 | Aoyama et al. | 439/701 |

FOREIGN PATENT DOCUMENTS 0 090 502 10/1983 (EP) .

* cited by examiner

*Primary Examiner*—Gary F. Paumen
*Assistant Examiner*—Phuongchi Nguyen
(74) *Attorney, Agent, or Firm*—Banner & Witcoff, Ltd.

(57) ABSTRACT

A connector comprises a pair of mutually engageable male and female connector housings (10,11) and a housing retaining member (40) retained in one of the connector housings (10). The retaining member (40) is movable between a temporary fitted position whereupon the connector housings (10,11) can be slid together in a fitting direction, and a fully fitted position which locks the connector housings (10,11) together. The retaining member (40) is provided with resilient locking arms (46) extending laterally from opposing sides thereof. The locking arms (46) are received in corresponding recesses of the connector housing (10) when the retaining member (40) is in the temporary fitted position. As the connector housings (10,11) are slid together, abutment surfaces (19, 19A) of the other of the connector housings (11) urge the locking arms (46) from the recesses (26). The retaining member (40) can then be moved to the fully fitted position.

12 Claims, 9 Drawing Sheets

CONNECTOR

TECHNICAL FIELD

The present invention relates to a connector retaining a pair of connector housings by means of a housing retainer member.

BACKGROUND TO THE INVENTION

A conventional example of this type of connector is described in EP 0090502, A2. As shown in FIG. 13 of this specification, this connector is provided with a pair of housings 1 and 2 capable of fitting mutually together. When the housings 1 and 2 are in a completely fitted state, a locking member 3 formed on an upper face of the housing 1 passes through and engages a protruding member 4 shaped like an inverted U and formed on the housing 2. In this state, a housing retaining member 5 is passes horizontally through the locking member 3 and the housings 1 and 2 are thereby retained in a fitted state. At this juncture a half-fitted state can be detected because member 5 cannot be installed into the locking member 3.

However, the two housings of a connector are usually installed into the ends of separate harnesses at a harness factory and are then transported to an assembly site (such as an automobile assembly site, etc.). At this juncture, the housing retaining member 5 and the housings 1 and 2 of the conventional connector are in a separated state. Consequently, it is troublesome to control these components, and a troublesome assembly operation must be performed at the assembly site. Alternatively, in a configuration whereby the housing retaining member temporarily stops the housings and is pushed into a main stopping position at the assembly site, there is the risk that the housing retaining member might strike against other components while being transported and thereby move into the main stopping position. If the temporary stopping strength of the housing retaining member is merely increased in order to deal with this problem, the operation of pushing in the housing retaining member at the assembly site is rendered more difficult.

The present invention has been developed after taking the above problem into consideration, and aims to present a connector in which the housing retaining member can be reliably retained in a temporary stopping position while the connector is in a separated state, and in which the assembly operation of the housing retaining member can be performed easily.

According to the present invention there is provided a connector comprising male and female connector housings mutually engageable in a fitting direction, one of said connector housings being provided with a housing retaining member movable in a direction intersecting said fitting direction between a temporary fitted position and a fully fitted position, the temporary fitted position allowing the connector housings to be fitted together and the fully fitted position retaining the connector housings in a fully fitted state, the housing retaining member being provided with a resilient locking arm protruding in a direction intersecting said fitting direction, and said one of the connector housings being provided with a recess within which the locking arm is received when the retaining member is in the temporary fitted position, wherein the other of the connector housings is provided with an abutment surface adapted to move the locking arm as the connector housings are fitted together, thereby disengaging the locking arm from the recess and permitting movement of the housing retaining member from the temporary fitted position to the fully fitted position.

With the locking arm of the housing retaining member received in the recess of the connector housing, the housing retaining member is resistant to external forces, for example experienced during transportation, acting to move it to the fully fitted position. The aforementioned problems associated with having a separate housing retaining member are also alleviated.

In a preferred embodiment the recess is provided in a partition wall of said one of the connector housings and the locking arm overlies an edge of said partition wall when the housing retaining member is in the fully fitted position. By overlying an edge of the wall, the locking arm retains the housing retaining member in the fully fitted position.

The partition wall and locking arm may be provided with respective angled portions which face one another when the housing retaining member is in the fully fitted position, these angled portions being adapted to urge the locking arm from its position overlying the partition wall when the housing retaining member is moved from the fully fitted position. The tapered portions allow the housing retaining member to be moved to the temporary fitted position, for example to allow the connector housings to be separated, without damaging the locking arm. The angled portions are arranged so as to deflect the locking arm away from the edge of the partition wall when the housing retaining member is moved from the fully fitted position.

In a preferred embodiment, the housing retaining member includes an upstanding contact member adapted to contact said other of the connector housings if the connector housings are fitted together with the housing retaining member in the fully fitted position, the contact member being adapted to move the housing retaining member to the temporary fitted state as a result of further movement of said other of the connector housings in the fitting direction. The contact member is preferably provided with a tapered contact face, said tapered contact face intersecting diagonally with the direction of fitting of the connector housings.

BRIEF DESCRIPTION OF THE DRAWINGS

Other features of the invention will be apparent from the following description of a preferred embodiment shown by way of example only, in which.

DESCRIPTION OF PREFERRED EMBODIMENTS

Figure 1:
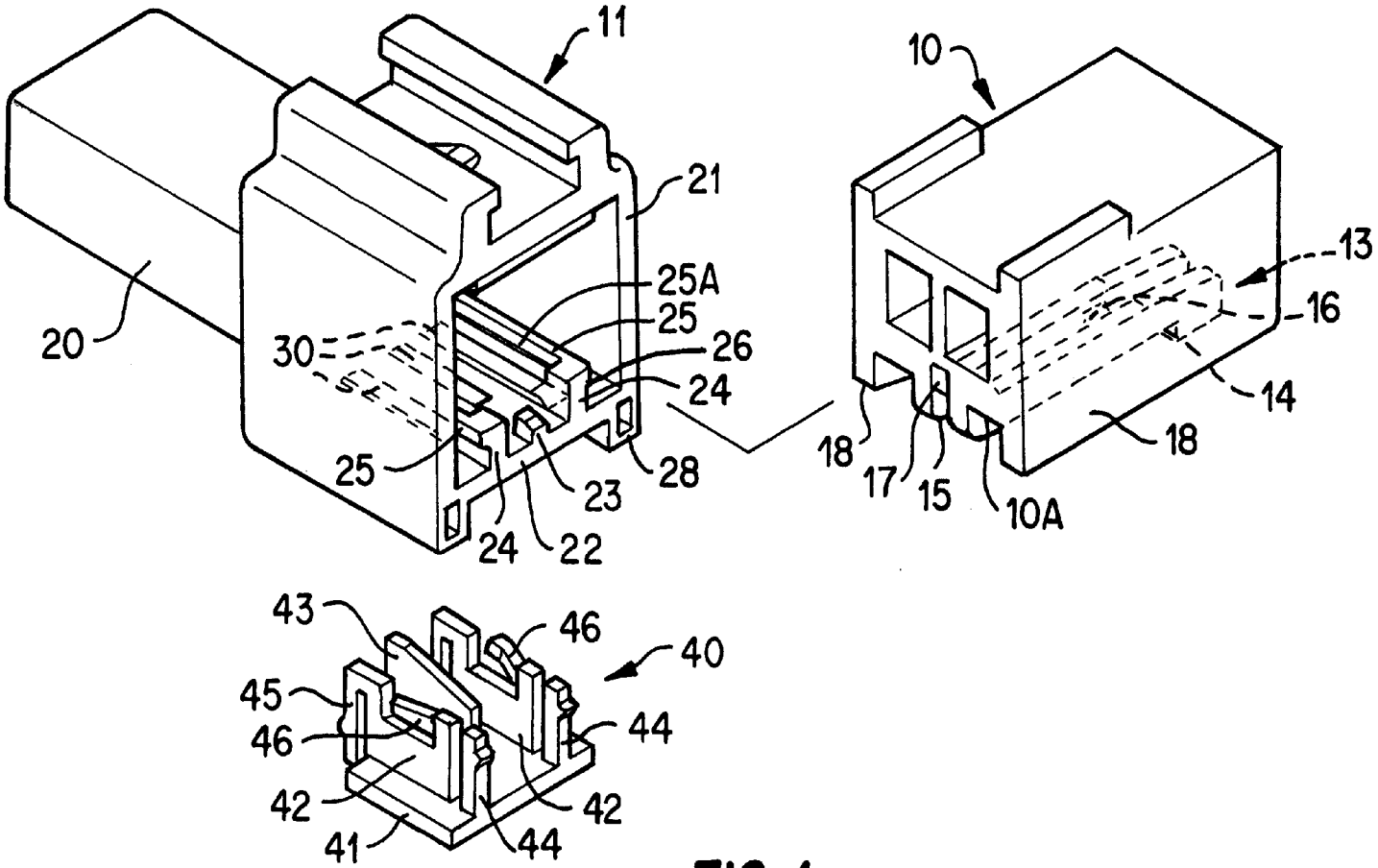
FIG. 1 is a diagonal view of a connector of an embodiment of the present invention.

An embodiment of the present invention is described below with the aid of FIGS. 1 to 12. A connector of the present embodiment, shown in its entirety in FIG. 1, is provided with a female connector housing 10 and a male connector housing 11 capable of fitting mutually together. Hereafter, the fitting face side of the female connector housing 10 and of the male connector housing 11 shall be referred to as the anterior side.

Figure 2:
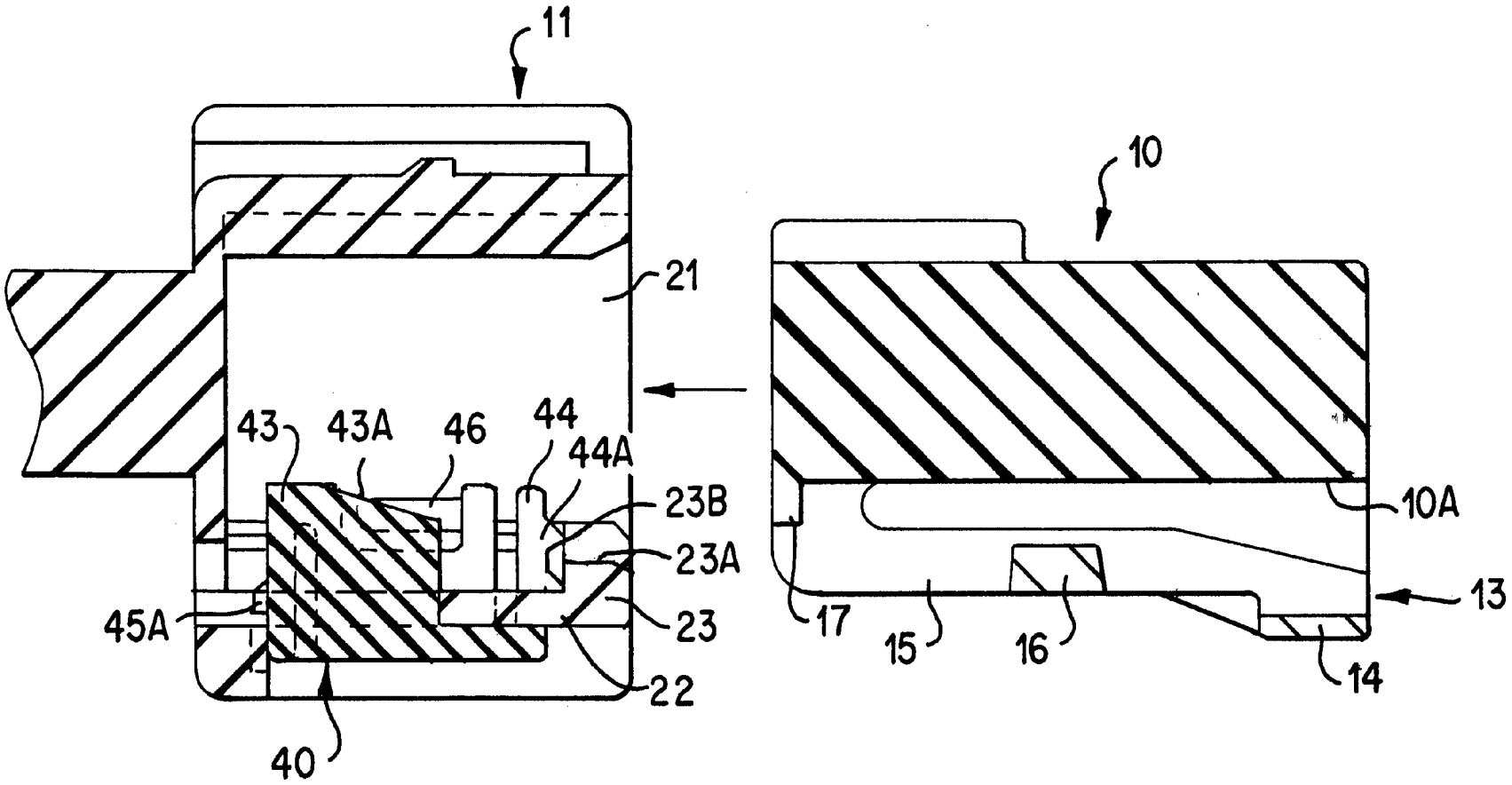
FIG. 2 is a side cross-sectional view of the centre, in a width-wise direction, of the connector when a housing retaining member is in a main stopping position.

As shown on the right side of FIG. 1, the female connector housing 10 (hereafter referred to as the female housing 10) forms a rectangular parallelipiped shape, the interior thereof housing female terminal fittings (not shown). A locking arm 13 is provided on a lower face 10A of this female housing 10. As shown in FIG. 2, the locking arm 13 forms a cantilever which drops downwards from an anterior end of the female hosing 10 and extends horizontally, a pushing member 14 being provided on the posterior end thereof. Further, a slit 15 which extends in a longitudinal direction is formed in the centre (with respect to the width-wise direction) of the locking arm 13. This slit 15 is intersected by a stopping wall 16 located at the centre, in a longitudinal direction, of the locking arm 13. A receiving wall 17 drops downwards from the anterior end of the lower face 10A of the female housing 10. As shown in FIG. 2, a portion of this receiving wall 17 intersects with the end of the slit 15.

Figure 6:
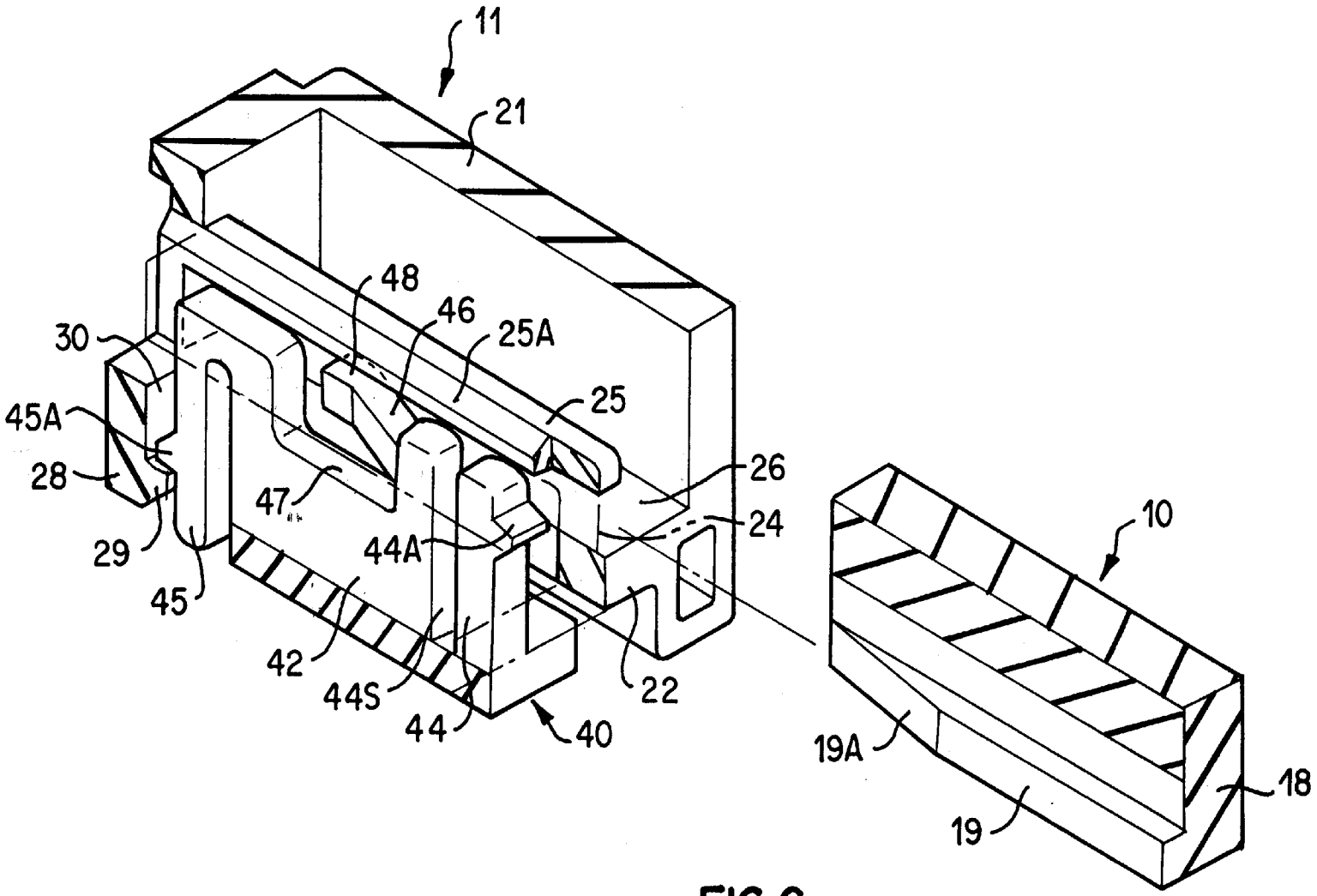
FIG. 6 is an enlarged diagonal view showing the housing retaining member in the temporary stopping position, a portioning wall and a regulating rail.

As shown in FIG. 1, a pair of regulating rails 18 are provided symmetrically to the left and right at the two edges of the lower face 10A of the female housing 10. These regulating rails 18, which are shown in an enlarged form in FIG. 6, are cross-sectionally L-shaped and have projecting members 19 which protrude from tips of inner side faces thereof towards the locking arm 13. Tapered faces 19A are provided on the anterior sides of these projecting members 19, these tapered faces 19A inclining further away from the locking arm 13 the closer they are to the anterior side.

The male connector housing 11, shown on the left side in FIG. 1, is provided with an angular tubular shaped hood member 21 to the anterior of a terminal housing member 20 which houses male terminal fittings (not shown). A lower wall 22 of the hood member 21, at the lower side of FIG. 1, has a locking protrusion 23 which protrudes from the centre of the anterior end of the lower wall 22 towards the interior of the hood member 21. As shown in FIG. 2, the locking protrusion 23 has a tapered face 23A at its anterior side, and its posterior side has a stopping face 23B which is approximately perpendicular.

Figure 7:
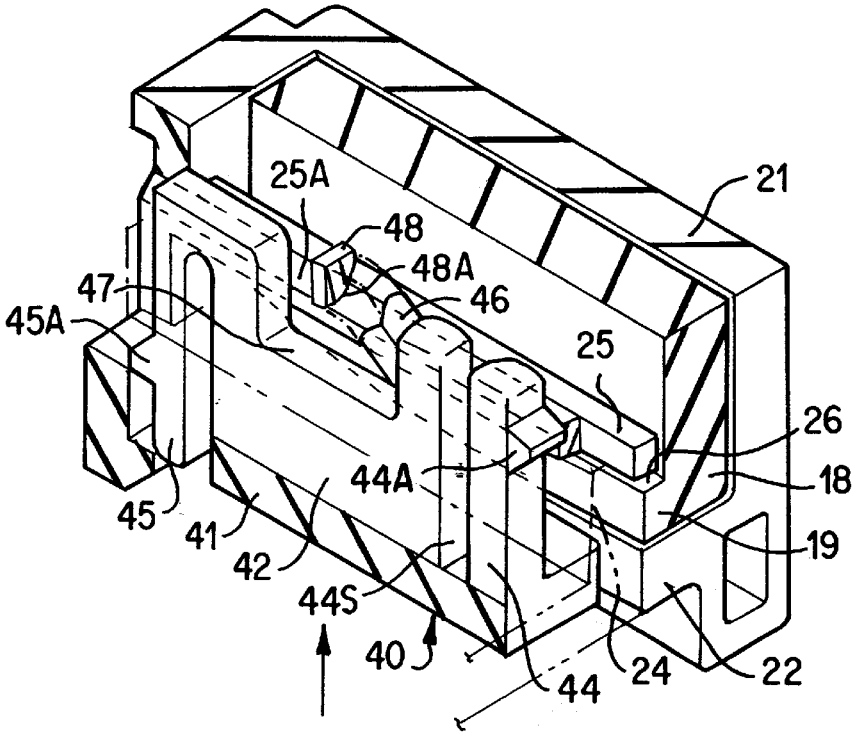
FIG. 7 is an enlarged diagonal view showing the housing retaining member in the main stopping position, a portioning wall and a regulating rail.

As shown in FIG. 1, a pair of short columns 24 are formed on an inner face of the lower wall 22, these short columns being formed symmetrically to the left and right of the locking protrusion 23. Angular column shaped partitioning walls 25 extend between each short column 24 and the innermost wall of the hood member 21. More specifically, the partitioning walls 25 are connected to the end portions of the short columns 24 at side faces thereof which are on the sides opposite to the locking protrusion 23. These partitioning walls 25 protrude outwards in a sideways direction away from the short columns 24. As shown in FIGS. 6 and 7, opening spaces 26 that open to the anterior of the male housing 11 are formed between the partitioning walls 25 and the lower wall 22, the projecting members 19 of the regulating rails 18 being inserted therein. Moreover, tapered faces 25A inclining towards the interior side are formed on upper faces of the partitioning wails 25.

Figure 8:
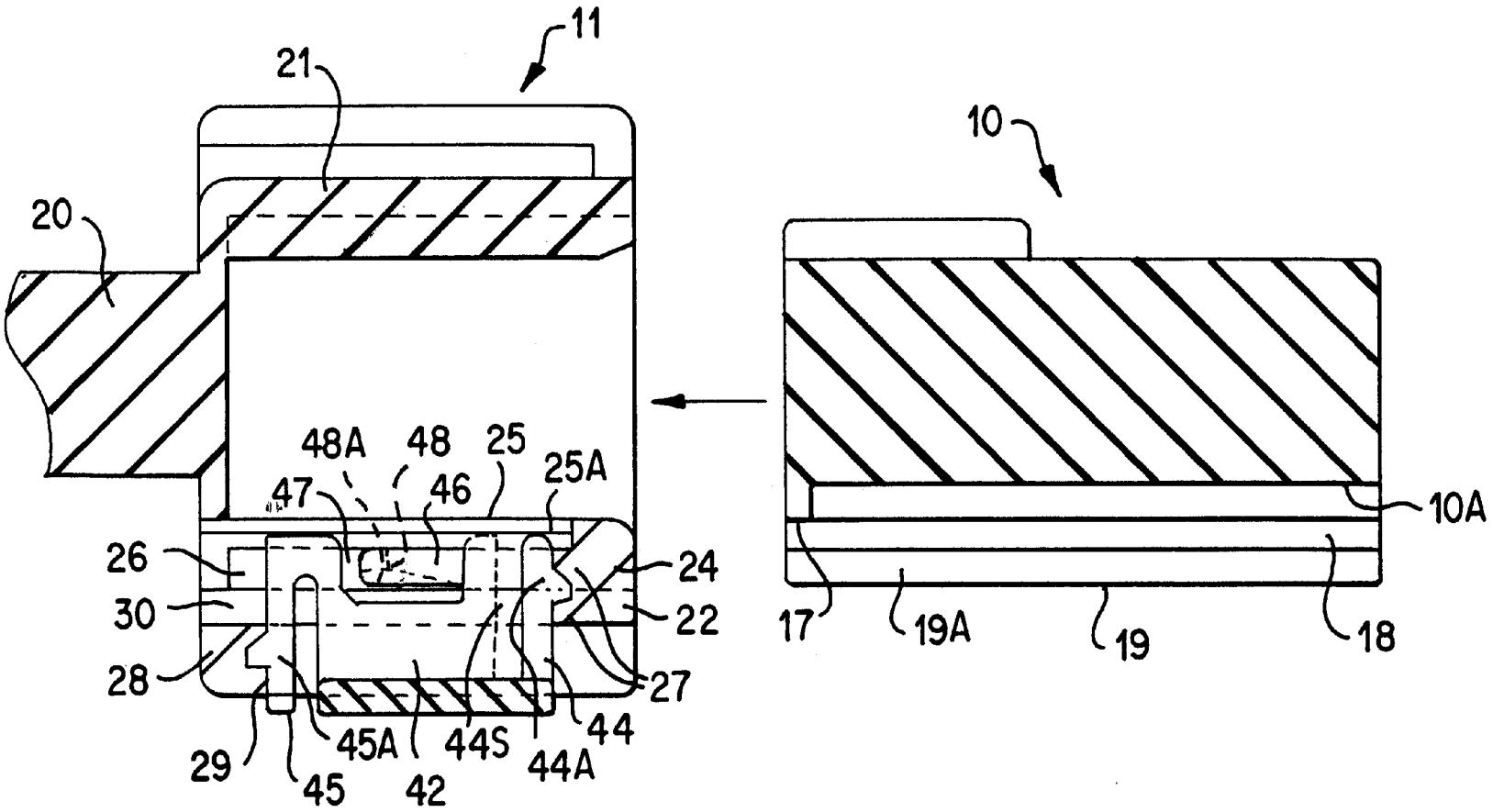
FIG. 8 is a side cross-sectional view showing the connector in a separated state and the housing retaining member in the temporary stopping position.
Figure 9:
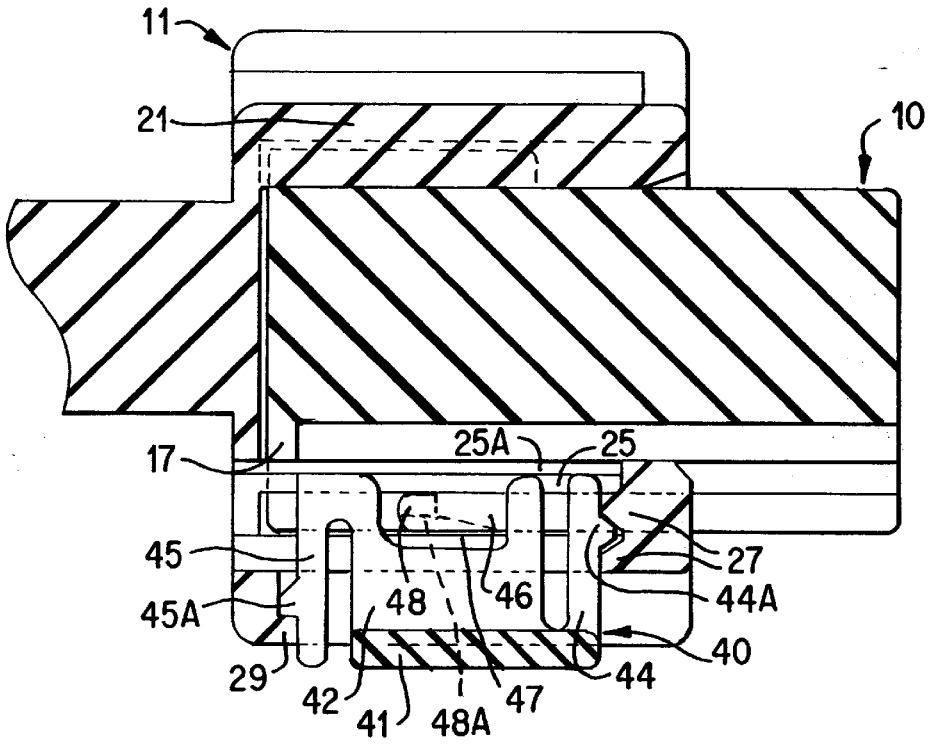
FIG. 9 is a side cross-sectional view showing the connector in the fitted state and the housing retaining member in the temporary stopping position.

As shown in FIG. 1, three slits 30 extending in the direction of fitting pass through the lower wall 22 of the hood member 21. These slits 30 are formed farther to the interior, in the direction of fitting, than the locking protrusion 23 and the short columns 24. As shown in FIG. 8, the anterior of each of the two slits 30 located at the sides has an inner face, these forming a unified face with a posterior face of the short columns 24. A pair of stopping protrusions 27 are formed in an up-down direction thereon. A protecting wall 28 drops downwards from a posterior end of the lower wall 22, and stopping protrusions 29 protrude in an anterior direction from a lower end of a portion of the protecting wall 28 that is closer to the two side slits 30. A housing retaining member 40 (to be explained next) is engaged by these stopping protrusions 27 and 29.

The housing retaining member 40, shown in its entirety in FIG. 1, is provided with a pair of main protruding walls 42 rising vertically upwards from locations adjacent to two edges of a plate-shaped base member 41, and a secondary protruding wall 43 rising vertically from the centre of the base member 41. The housing retaining member 40 is installed on the male housing 11 by passing these protruding walls 42 and 43 through the slits 30 of the hood member 21.

The secondary protruding wall 43, shown from the side in FIG. 2, is provided with a returning tapered face 43A that relates to the present invention, this returning tapered face 43A facing in an anterior direction from the anterior end portion of the secondary protruding wall 43 and inclining downwards.

Each of the main protruding walls 42, shown from the side in FIG. 8, is provided at the anterior and posterior with a pair of stopping arms 44 and 45. The first stopping arm 44, located at the anterior, is formed so as to be a portion of the main protruding wall 42, being separated therefrom by a slit 44S which opens into the main protruding wall 42 and extends from an upper edge thereof down towards a base edge. The second stopping arm 45, located at the posterior, extends upwards from an upper edge of a posterior face of the main protruding wall 42 and then extends vertically downwards. A stopping protrusion 44A protruding in an anterior direction is formed on each first stopping arm 44 adjacent to the end thereof, and a stopping protrusion 45A protruding in a posterior direction is formed on each second stopping arm 45 adjacent to the lower edge thereof. These stopping protrusions 44A and 45A are engaged by the stopping protrusions 27 and 29 formed on the hood member 21.

Figure 11:
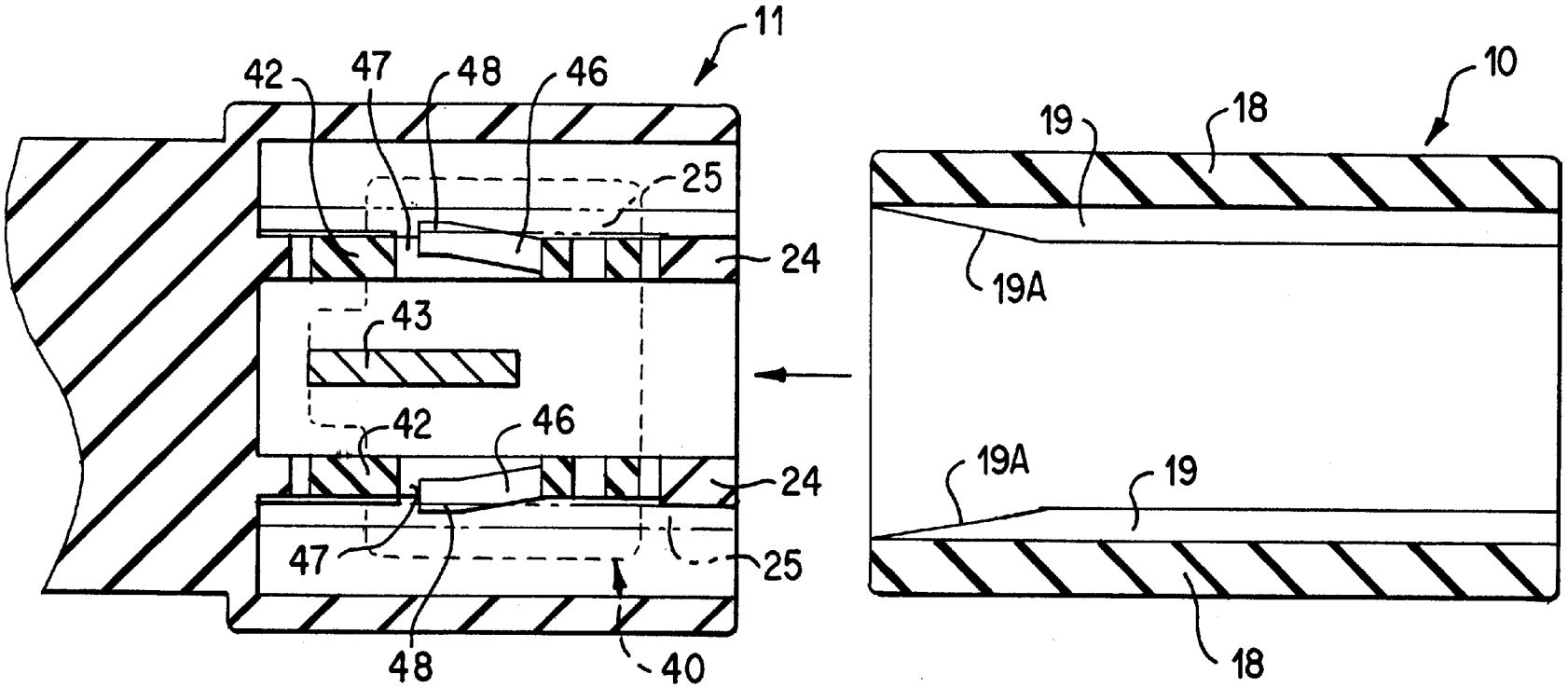
FIG. 11 is a plan cross-sectional view of a locking member in a protruding state.

A locking member 46 relating to the present invention is provided on the upper edge of each main protruding wall 42. A cavity 47 opens from the upper edge of the main protruding wall 42, and the locking member 46 is located therein. This locking member 46 has a cantilevered shape and extends in a posterior direction from an inner face at the anterior end of the main protruding wall 42. More specifically, each locking member 46 has an angular column shape and, as shown in FIG. 11 inclines further away from the secondary protruding wall 43 the further it extends towards the posterior, relative to the direction of fitting of the connector. The tip portion of each locking member 46 turns back towards the secondary protruding wall 43 and extends in the direction of fitting of the connector, forming a stopping end 48. Each stopping end 48 protrudes out beyond the side face of the main protruding wall 42 and, as shown in FIG. 6, is housed within the opening space 26 below the partitioning wall 25 when the housing retaining member 40 is pushed into the temporary stopping position. As shown in FIG. 7, each stopping end 48 is housed on the upper side of the partitioning wall 25 when the housing retaining member 40 is pushed into the main stopping position. The upper face of each stopping end 48 is flat and, when the housing retaining member 40 is in the temporary stopping position, is face-to-face with a lower face of the partitioning wall 25 in the direction of sliding of the housing retaining member 40. A tapered face 48A (see FIGS. 7 and 8) is formed at a lower side of each stopping end 48 and, when the housing retaining member 40 is in the main stopping position, it is face-to-face with the tapered face 25A on the upper face of the partitioning wall 25 in a direction intersecting with the direction of sliding of the housing retaining member 40.

Next, the operation and effects of the connector of the present embodiment will be explained. In the case of the connector of the present embodiment, the housing retaining member 40 is installed at the connector production side as far as the temporary stopping position of the male housing 11. As shown in FIG. 6, as this happens the stopping ends 48 of the locking members 46 provided on the housing retaining member 40 enter into the opening spaces 26 of the male housing 11 and are gripped between the lower wall 22 and the partitioning walls 25. Simultaneously, the stopping protrusions 44A and 45A formed on the stopping arms 44 and 45 of the housing retaining member 40 are engaged by the stopping protrusions 27 and 29 formed on the male housing 11, and the up-down movement of the housing retaining member 40 is thus regulated. Next, the connector is shipped to, for example, a harness factory with the housings 10 and 11 in a separated state.

At the harness factory, the two housings 10 and 11 are installed into the ends of separate harnesses (not shown) and those harnesses are transported in a separated state to, for example, an automobile assembly site. It is possible that, during these processes, the housing retaining member 40 may make contact with other components and be pushed towards the main stopping position. However, the locking members 46 and the stopping arms 44 and 45 engage with the parts (described above) of the male housing 11 and therefore prevent the housing retaining member 40 from moving to the main stopping position. At this point, the stopping ends 48 of the locking members 46 are face-to-face with the partitioning wall 25 in the direction of sliding of the housing retaining member 40, and therefore, even if the housing retaining member 40 is pushed strongly, this pushing force does not cause the stopping ends 48 of the locking members 46 to move resiliently in a direction of release of contact with the partitioning wall 25. In this manner, the movement of the housing retaining member 40 into the main stopping position can reliably be prevented.

Figure 12:
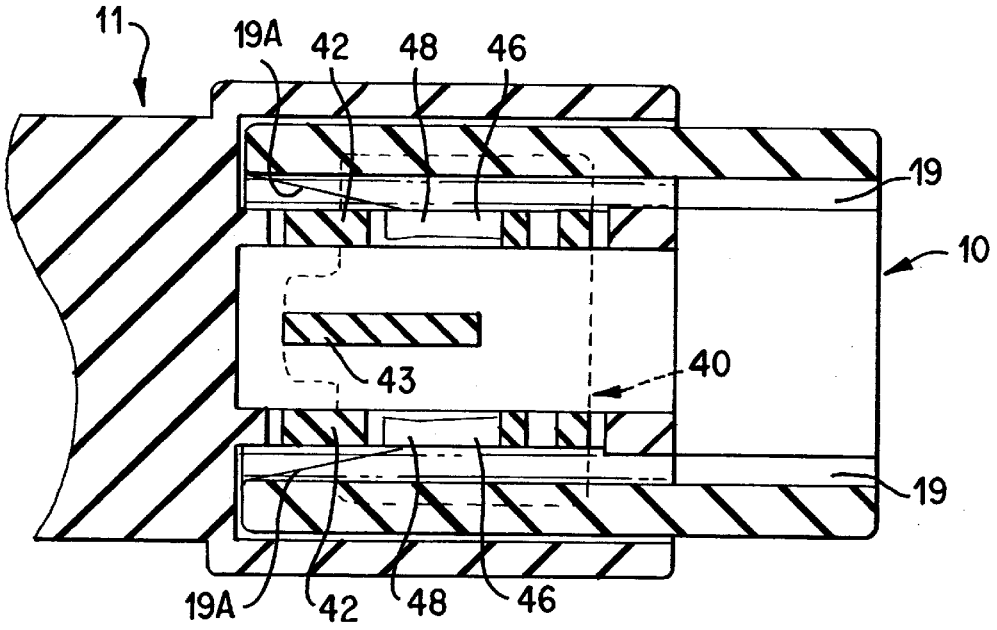
FIG. 12 is a plan cross-sectional view of the locking member in a moved-away state.
Figure 13:
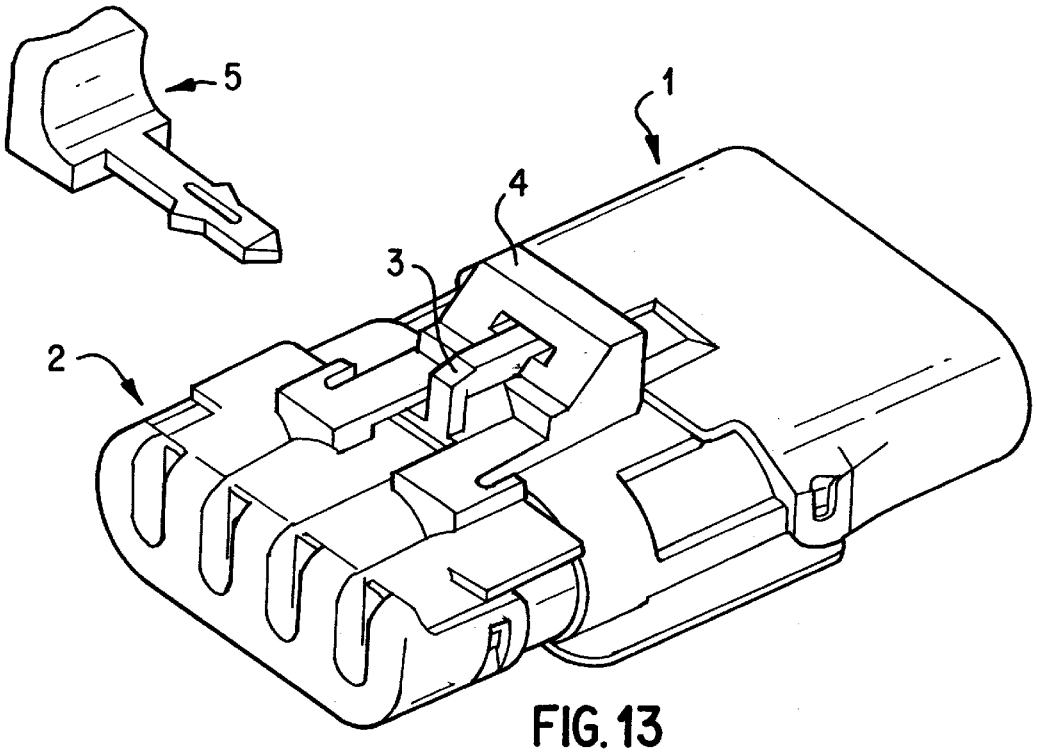
FIG. 13 PRIOR ART
FIG. 13 is a diagonal view of a conventional connector.

The housings 10 and 11 are fitted together as follows. The female housing 10 is pushed into the hood member 21 of the male housing 11. Next, the stopping wall 16 of the locking arm 13 provided on the female housing 10 rises over the locking protrusion 23 provided inside the hood member 21 of the male housing 11 and engages the stopping face 23B provided at the innermost side of this locking protrusion 23 (see FIG. 4). The two housings 10 and 11 are thereby locked in a fitted state. During this fitting process, the regulating rails 18 of the female housing 10 are inserted into the opening spaces 26 of the male housing 11, and the stopping ends 48 of the locking members 46 slide along the tapered faces 19A of the regulating rails 18 and are pushed into the interior. next, as shown in FIG. 12, when the connector has reached a completely fitted state, the locking members 46 resilient change shape and the stopping ends 48 reach a state whereby they have moved away from the opening spaces 26.

While the locking members 46 are in this moved-away state, the housing retaining member 40 is pushed into the main stopping position. While this is being done, the first stopping arms 44 rise over the stopping protrusions 27 of the male housing 11 and change shape (see FIG. 3) and, immediately after the housing retaining member 40 has reached the main stopping position, the first stopping arms 44 return to their original position and are retained against the upper faces of the stopping protrusions 27 of the male housing 11 (see FIG. 4). At this juncture, the locking members 46 are in the moved-away state (see FIG. 12), and the stopping ends 48 of the locking members 46 and the partitioning walls 25 do not interfere with the direction of sliding of the housing retaining member 40. Consequently, the housing retaining member 40 can easily be pushed into the main stopping position. When the housing retaining member 40 reaches the main stopping position, the locking members 46 return to their original position and remain above the upper faces for the partitioning walls 25 (see FIG. 7).

Figure 5:
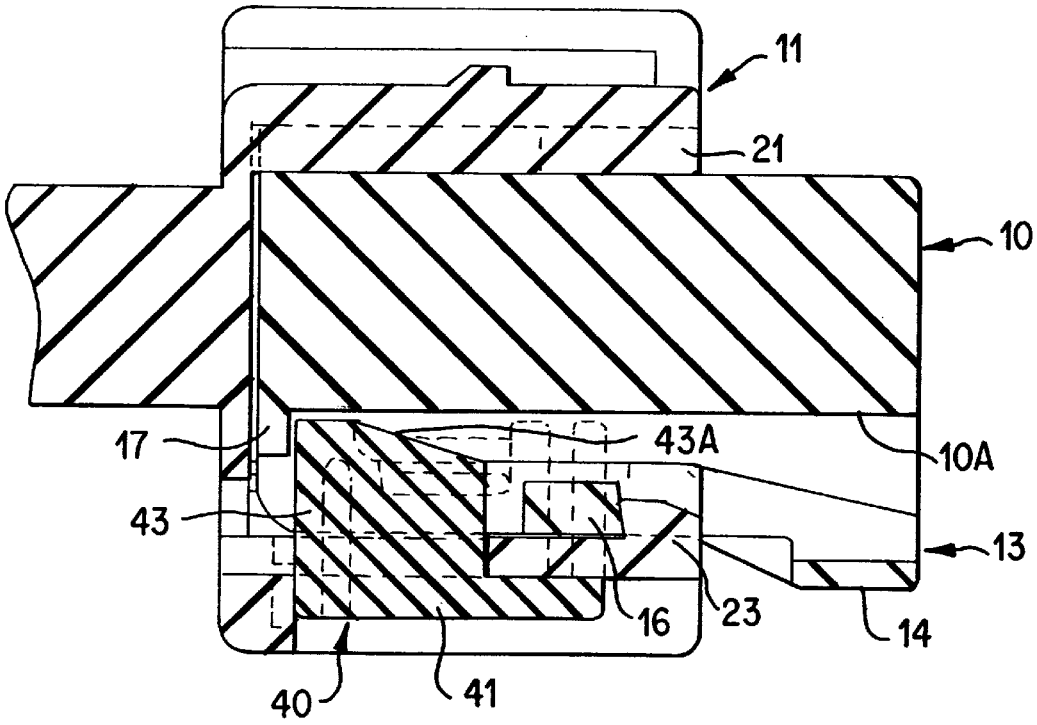
FIG. 5 is a side cross-sectional view showing the housing retaining member having been pushed into the main stopping position when the connector is in the completely fitted state.
Figure 10:
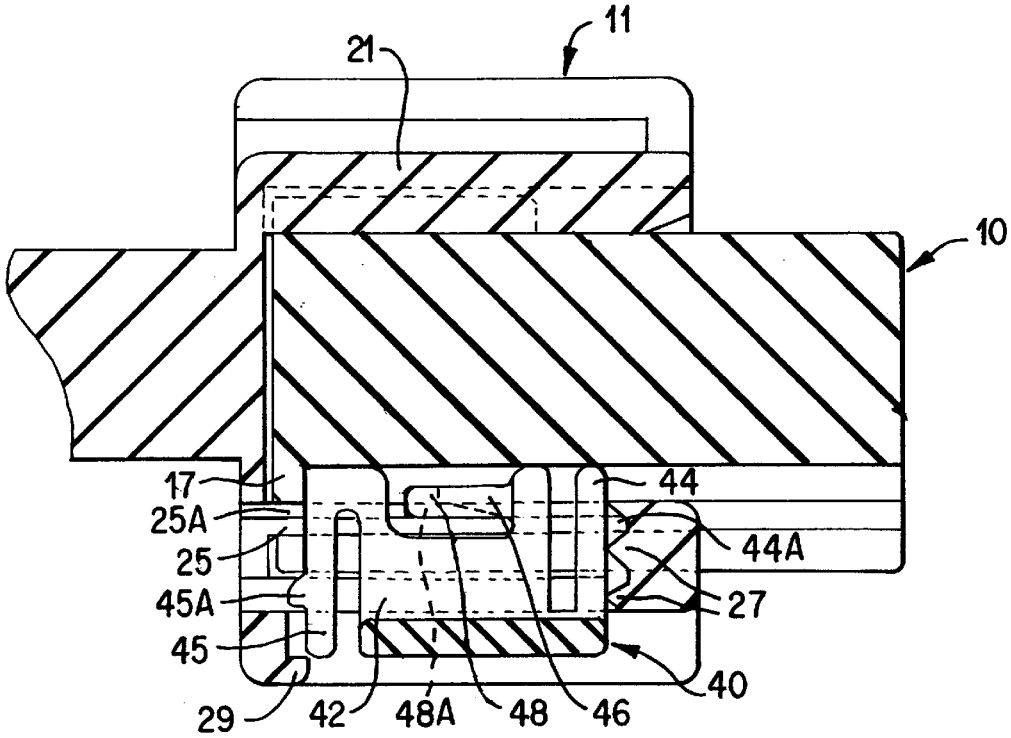
FIG. 10 is a side cross-sectional view showing the connector in the fitted state and the housing retaining member in the main stopping position.

As shown in FIGS. 5 and 10, after the housing retaining member 40 has been engaged in the main stopping position, posterior end faces of the main protruding wails 42 and the secondary protruding wall 43 provided on the housing retaining member 40 are engaged against a posterior end face of the receiving wall 17 formed on the female housing 10. In this manner, the housings 10 and 11 are doubly stopped by both the locking arm and the housing retaining member 40.

If the operation should mistakenly attempt to complete the fitting operation as if the two housings 10 and 11 were in a completely fitted stated when they are actually in a half-fitted state, when the member 40 acts as a fitting detecting member and is pushed in, anterior end faces of the protruding walls 42 and 43 of the member 40 will make contact with a lower face of the receiving wall 17 of the female housing 10, thereby making it impossible to push the member 40 to the main stopping position. By this means, the operator can detect that the housings 10 and 11 are in a half-fitted state.

Figure 3:
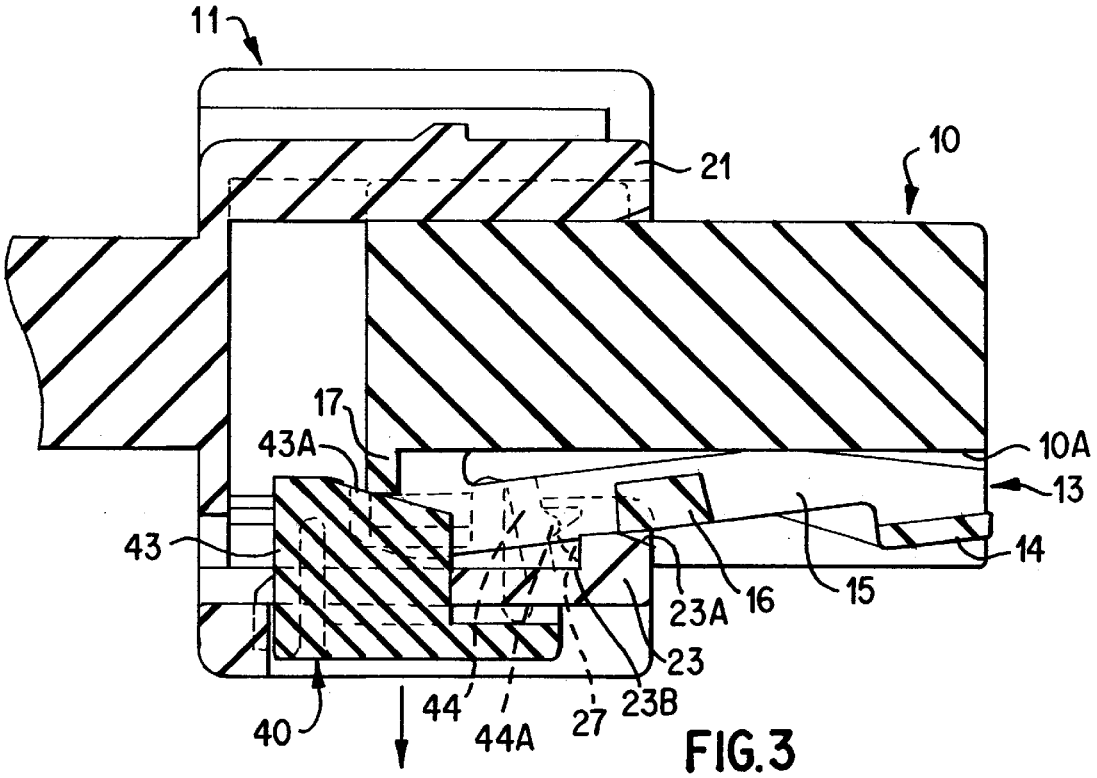
FIG. 3 is a side cross-sectional view showing the retaining member when it has been pushed from a main stopping position into a temporary stopping position by a corresponding connector housing.
Figure 4:
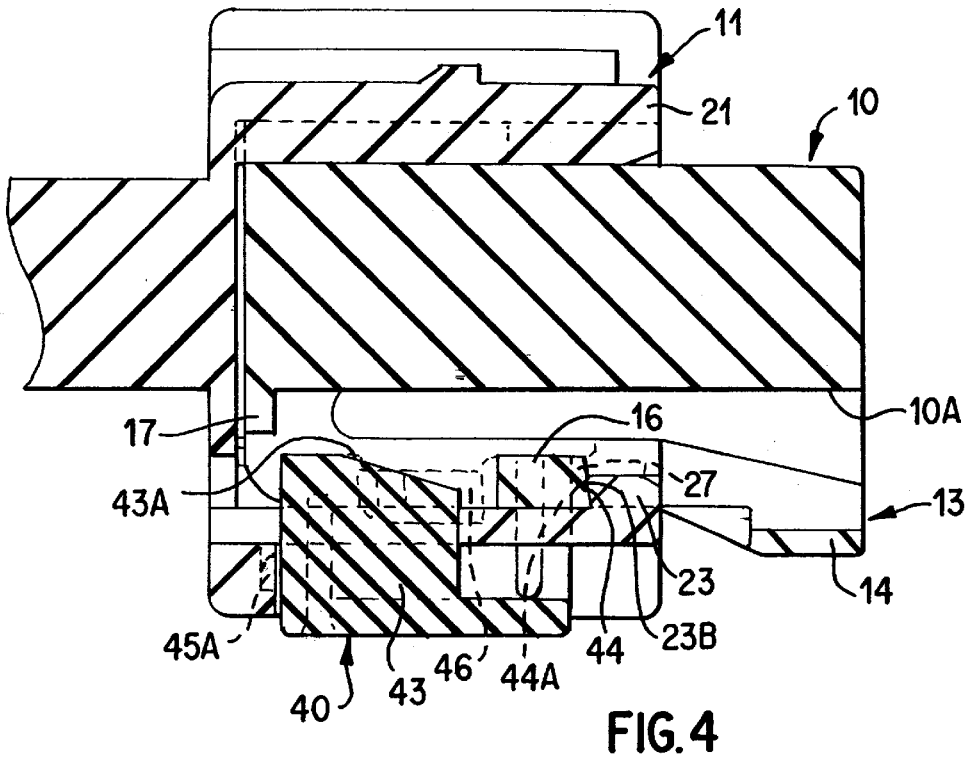
FIG. 4 is a side cross-sectional view showing the connector in a completely fitted state.

In the connector of the present embodiment, even if the housing retaining member 40 were to somehow reach the main stopping position while the connector is in a separated state, assembly can be performed merely by fitting the two housings 10 and 11 together. That is, as shown in FIGS. 2 to 4, when the housings 10 and 11 are fitted together, the returning tapered face 43A provided on the secondary protruding wall 43 of the housing retaining member 40 makes contact with the female housing 10 and the housing retaining member 40 is pushed downwards. Consequently, the tapered faces 48A and 25A provided on opposing portions of the locking members 46 and the partitioning walls 25 are pushed (see FIG. 7), the locking members 46 resiliently change shape and move into the moved-away state, and the engagement with the partitioning walls 25 is released. Furthermore, the stopping protrusions 44A of the first stopping arms 44 and the stopping protrusions 27 of the make housing 11 all have tapered faces (see FIG. 2) which make sliding contact with one another and thereby release the engagement of the stopping protrusions 44A and the stopping protrusions 27. As a result, the housing retaining member 40 is able to move downwards and, when the housings 10 and 11 have reached the fully fitted state, the housing retaining member 40 automatically returns to the temporary stopping position. Next, the housing retaining member 40 may be pushed into the main stopping position.

In this manner, according to the connector of the present invention, the housing retaining member 40 can be reliably retained in the temporary stopping position when the connector is in a separated state. Consequently, unlike the conventional example, there is no danger that housing retaining members which have been inadvertently moved into the main stopping position while connectors were being fitted together need to be returned one by one to the temporary stopping position. Moreover, when the connector is in a fitted state, the housing retaining member 40 can easily be pushed into the main stopping position, and consequently the operability of assembling the connector improves. In addition, even if the housing retaining member 40 were somehow to be in the main stopping position, an operation to return the housing retaining member 40 to the temporary stopping position when the housings 10 and 11 are being fitted together is not required, and efficiency of operability therefore improves.

The housings 10 and 11 can be separated from a fitted state by pulling the housing retaining member 40 from the main stopping position to the temporary stopping position, and pushing the pushing member 14 of the locking arm 13 while simultaneously pulling the female housing 10 out of the hood member 21.

The present invention is no limited to the embodiments described above with the aid of figures. For example, the embodiments described below also lie within the technical range of the present invention. In addition, the present invention may be embodied in various other ways without deviating from the scope thereof.

(1) The locking arm 46 of the embodiment described above has a cantilevered shape. However, it may equally well have, for example, an arched shape, the centre thereof being provided with a protrusion which protrudes towards the opening space 26.

(2) The locking arm 46 of the embodiment described above extends in the direction of fitting of the connector. However, it may equally well have a configuration whereby it extends in a direction which intersects with the direction of fitting of the connector.

A connector which can reliably retain a housing retaining member in a temporary stopping position when the connector is separated, and in which an assembly operation of the housing retaining member can be performed easily is provided.

A housing retaining member 40 provided in a manner capable of sliding within a male housing 11 has locking members 46 provided thereon, these locking members 46 being capable of changing shape in a direction intersecting with the direction of sliding. When two housings 10 and 11 are in a separated state, the locking members 46 are engaged against partitioning walls 25 provided on the male housing 11 and prevent the housing retaining member 40 from moving into a main stopping position. When the housings 10 and 11 have been fitted together, the locking members 46 resiliently change shape and their engagement with the partitioning walls 25 is released. The housing retaining member 40 can then be moved into the main stopping position.

What is claimed is:

1. A connector comprising male and female connector housings mutually engageable in a fitting direction, one of said connector housings being provided with a housing retaining member movable between a temporary fitted position and a fully fitted position, the temporary fitted position allowing the connector housings to be fitted together, and the fully fitted position retaining the connector housings in a fully fitted state, the housing retaining member being provided with a protruding resilient locking arm, and said one of the connector housings being provided with a recess within which the locking arm is received when the retaining member is in the temporary fitted position to prevent the retaining member from being moved to the fully fitted position, wherein the other of the connector housings is provided with an abutment surface that moves the locking arm out of the recess as the connector housings are fitted together, thereby disengaging the locking arm from the recess and permitting movement of the housing retaining member from the temporary fitted position to the fully fitted position.

2. The connector as claimed in claim 1 wherein the recess is an aperture and the locking arm projects therethrough when the housing retaining member is in the temporary fitted position.

3. The connector as claimed in claim 1 wherein the abutment surface of said other of the connector housings is defined by a lip extending in the fitting direction.

4. The connector as claimed in claim 1 wherein the recess is provided in a partition wall of said one of the connector housings.

5. The connector as claimed in claim 4 wherein said locking arm overlies an edge of said partition wall when the housing retaining member is in the fully fitted position, and thereby retains the housing retaining member in the fully fitted position.

6. The connector as claimed in claim 5 wherein the partition wall and locking arm are provided with respective angled portions which face one another when the housing retaining member is in the fully fitted position, said angled portions being adapted to urge the locking arm from its position overlying the partition wall when the housing retaining member is moved from the fully fitted position.

7. A connector comprising male and female connector housings mutually engageable in a fitting direction, one of said connector housings being provided with a housing retaining member movable in a direction intersecting said fitting direction between a temporary fitted position and a fully fitted position, the temporary fitted position allowing the connector housings to be fitted together, and the fully fitted position retaining the connector housings in a fully fitted state, the housing retaining member being provided with a resilient locking arm protruding in a direction intersecting said fitting direction, and said one of the connector housings being provided with a recess within which the locking arm is received when the retaining member is in the temporary fitted position, wherein the other of the connector housings is provided within abutment surface adapted to move the locking arm as the connector housings are fitted together, thereby disengaging the locking arm from the recess and permitting movement of the housing retaining member from the temporary fitted position to the fully fitted position, and wherein the housing retaining member includes an upstanding contact member, the contact member being adapted to move the housing retaining member from the fully fitted position to the temporary fitted position on mutual movement of the connector housings in the fitting direction.

8. A connector as claimed in claim 7, wherein the housing retaining member is provided with two locking arms protruding laterally from opposing sides thereof.

9. A connector as claimed in claim 8 wherein the contact member is provided between the locking arms.

10. A connector as claimed in claim 7 wherein the contact member has a tapered contact face, said tapered contact face intersecting diagonally with the direction of fitting of the connector housings.

11. A connector as claimed in claim 10, wherein the housing retaining member is provided with two locking arms protruding laterally from opposing sides thereof.

12. A connector as claimed in claim 11 wherein the contact member is provided between the locking arms.

* * * * *